US005568709A

United States Patent [19]

Steckler

[11] Patent Number: 5,568,709

[45] Date of Patent: Oct. 29, 1996

[54] SIMULATED DECORATIVE ARCHITECTURAL COLUMNS AND METHOD OF MAKING THE SAME

[76] Inventor: Richard D. Steckler, 1808 Channing Way, Berkeley, Calif. 94703

[21] Appl. No.: 508,815

[22] Filed: Jul. 28, 1995

[51] Int. Cl.[6] ..... E04H 12/00

[52] U.S. Cl. ..... 52/309.8; 52/730.1; 52/737.4; 52/738.1; 52/745.17; 29/897.33

[58] Field of Search ..... 52/309.4, 309.7, 52/309.8, 309.16, 309.17, 720.2, 721.4, 723.1, 730.1, 731.1, 731.2, 731.4, 737.4, 738.1, 746.1, 745.17–745.2, 423, 301, 730.7, 731.8, 732.1, 732.3, 737.1; 29/897.33

[56] References Cited

U.S. PATENT DOCUMENTS

| | | | |
|---|---|---|---|
| 154,852 | 9/1874 | Drake et al. | 52/737.4 |
| 672,646 | 4/1901 | Mereness | 52/730.7 X |
| 902,631 | 11/1908 | Wentworth | 52/731.4 |
| 1,000,822 | 8/1911 | Kyle | 52/731.4 X |
| 1,210,333 | 12/1916 | Kyle | 52/731.4 X |
| 1,350,686 | 8/1920 | Trudelle | 52/737.4 X |
| 2,728,479 | 12/1955 | Wheeler | 52/631 |
| 3,131,792 | 5/1964 | Groneman | 189/34 |
| 3,196,061 | 7/1965 | Paulson et al. | 52/745.17 X |
| 3,200,554 | 8/1965 | Goodman | 52/727 |
| 3,590,547 | 7/1971 | Molyneux | 52/728 |
| 3,961,654 | 6/1976 | Hasenwinkle | 52/745.19 X |
| 4,216,634 | 8/1980 | Binder | 52/309.9 |
| 4,961,258 | 10/1990 | Menzel | 52/747 |
| 5,172,532 | 12/1992 | Gibbar, Jr. | 52/309.12 |
| 5,271,878 | 12/1993 | Mizia et al. | 264/45.5 |
| 5,327,694 | 7/1994 | Gamel et al. | 52/727 |
| 5,335,471 | 8/1994 | Kupiec | 52/727 |

*Primary Examiner*—Robert Canfield
*Attorney, Agent, or Firm*—Schapp and Hatch

[57] ABSTRACT

Simulated decorative architectural columns comprising an axial member and a jacket surrounding the axial member. The jacket is comprised of a plurality of elongated rigid foam material members of truncated wedge-shaped cross-section, or jacket wedges. After the jacket is assembled around the axial member the outer surface of the jacket is sanded to provide a smooth surface, and the smooth surface is provided with an overcoating resembling a cut surface of stone. Groups of jacket wedges are fabricated from corresponding blanks by means of a hot-wire foam cutting machine. Each blank is first subdivided into a lower portion and an upper portion by a parting surface the profile of which is substantially identical to the intended profile of the finished column. The lower or relievo portion of the blank is then subdivided into a plurality of wedge members by a series of oblique cuts each extending from end to end of the lower portion of the blank.

12 Claims, 3 Drawing Sheets

SIMULATED DECORATIVE ARCHITECTURAL COLUMNS AND METHOD OF MAKING THE SAME

BACKGROUND OF THE INVENTION

1. Field of the Invention

The present invention relates to decorative architectural columns such as those configured in accordance with classic architectural orders and characterized by entasis, and more particularly to simulations of such columns and methods of making such simulations.

2. Description of the Prior Art

Simulated decorative architectural columns and methods of making the same are known in the prior art.

For example, U.S. Pat. No. 5,327,694, which was issued to Gamel, et al., on Jul. 12, 1994, shows and describes an ornamental building column comprising a tubular member made from cardboard having an applied covering layer of urethane foam that is formed into a desired shape.

As further taught in Gamel, an internal load bearing member of reenforced concrete is installed within the interior of the tubular member to make complete the structure.

In accordance with a further teaching of Gamel, a method of making a decorative building column is provided, comprising the steps of: applying a covering layer to the exterior of a tubular member as abovedescribed, sculpting the covering layer to a desired form, and installing a load bearing member within the interior of the tubular member.

In accordance with a particular embodiment of Gamel, the covering layer is sculpted by setting up the tubular member in a lathe and applying urethane foam to the rotating tubular member to establish a rough shape which is oversize but approximates the final desired form of the column to be created.

As yet further taught by Gamel, while the covered tubular member is still on the lathe the covering layer can be shaped to the desired final shape and the covering surface smoothed by sanding to create an appropriate finish, using conventional tools.

it is believed that the documents listed immediately below contain information which is or might be considered to be material to the examination of this patent application.

U.S. Pat. No. 3,131,792

U.S. Pat. No. 3,200,554

U.S. Pat. No. 3,590,547

U.S. Pat. No. 4,216,634

U.S. Pat. No. 4,961,258

U.S. Pat. No. 5,172,532

U.S. Pat. No. 5,271,878

U.S. Pat. No. 5,335,471

The term "prior art" as used herein or in any statement made by or for applicant means only that any document or thing referred to as prior art bears, directly or inferentially, a date which is earlier than the effective filing date hereof.

No representation or admission is made that any of the above-listed documents is part of the prior art, or that a search has been made, or that no more pertinent information exists.

A copy of each of the above listed or cited documents is supplied to the United States Patent and Trademark Office herewith.

SUMMARY OF THE INVENTION

It is an object of the present invention to provide novel simulated decorative architectural columns and novel methods of making the same.

Another object of the present invention is to provide a novel simulated decorative architectural column construction which is comprised of an axial, central post or core and a jacket affixed to said post or core, said jacket having an outer surface which is configured in accordance with the desired decorative column design.

Yet another object of the present invention is to provide a novel simulated decorative architectural column construction as abovedescribed in which said post may be a part of an existing building or other structure, or, alternatively, said core may be an independent, unattached member, as when simulated decorative architectural columns of the invention are used in theatrical stage settings.

A further object of the present invention is to provide simulated decorative architectural columns as abovedescribed in which the jacket of each such column is principally comprised of a plurality of elongated rigid foam members of wedge-shaped cross-section, which are sometimes called "jacket wedges" herein.

A yet further object of the present invention is to provide simulated decorative architectural columns as abovedescribed for any particular one of which a plurality of the jacket wedges may be automatically fabricated from a single blank of rigid foam material.

Another object of the present invention is to provide simulated decorative architectural columns as abovedescribed for which a plurality of the wedges of any particular column may be automatically fabricated from a single blank of rigid foam material by means of a pattern-following hot-wire foam cutting machine which is controlled in accordance with a pattern represented on a control drawing, and thus a wide variety of differently configured jacket wedges may be provided without the employment of highly skilled labor or extended machine down-time between runs of differently configured jacket wedges.

Yet another object of the present invention is to provide simulated decorative architectural columns as abovedescribed in which all of the jacket wedges of a single column may be quickly and inexpensively strapped or otherwise temporarily joined together for shipment to the site at which the corresponding simulated decorative architectural column is to be fabricated.

A further object of the present invention is to provide simulated decorative architectural columns in which a strapped set of jacket wedges as abovedescribed can be quickly and easily disjoined, and the set of jacket wedges applied to an existing post or core by closing said set around said post or core and cementing the wedges of the set to each other, thus forming a jacket around said post or core, sanding the outer face of the jacket, smooth and applying an overcoating to the sanded jacket.

Other objects of the present invention will in part be obvious, and will in part appear hereinafter.

The present invention, accordingly, comprises the several steps and the relation of one or more of such steps with respect to each of the others, and the apparatus embodying features of construction, combinations of elements, and arrangements of parts which are adapted to effect such steps, all as exemplified in the following disclosure, and the scope of the present invention will be indicated in the claims appended hereto.

In accordance with a principal feature of the present invention a simulated decorative architectural column is comprised of a post or core which is encased in a jacket of rigid foam material the outer face of which is configured in accordance with a predetermined decorative design.

In accordance with another principal feature of the present invention said outer face of said jacket may be configured in accordance with classic architectural orders, and further may incorporate the type of shaft profile known as entasis.

In accordance with yet another principal feature of the present invention said jacket is comprised of a plurality of elongated rigid foam members of wedge-shaped cross-section, sometimes denoted herein by the term "jacket wedges".

In accordance with a further principal feature of the present invention a column jacket thereof may be assembled around a core, post or other architectural support member and its component wedges joined together by means of a well known rigid foam adhesive, such as No. 117 Henry Adhesive.

In accordance with a yet further principal feature of the present invention a column jacket thereof may be configured to closely fit its associated core, post or other architectural support member, and may be adhered to its associated core, post or other architectural support member by means of a well known rigid foam adhesive; or the internal passage of the jacket may be larger than the associated core, post or other architectural support member, in which case the void between the jacket and the core, post or other architectural support member may be filled, e.g., with spray foam or other suitable filler material.

In accordance with another principal feature of the present invention the outer face of each jacket wedge of a jacket of the present invention which manifests entasis lies on a cylindrical surface, i.e., a continuous surface generated by the movement of a straight line segment or generator parallel to itself, the center point of the segment following the intended profile of the jacket.

In accordance with yet another principal feature of the present invention a plurality of the wedges of the jacket of a simulated decorative architectural column of the present invention may be made from a single elongated, substantially rectangular, or right parallelepipedal, block of rigid foam material having a top surface and a bottom surface of substantially the same large area, two substantially planar elongated side surfaces of substantially the same length as said top and bottom surfaces, and two substantially planar end surfaces, which block is sometimes called herein a "blank".

In accordance with another principal feature of the present invention the blank of rigid foam material from which a plurality of jacket wedges of the present invention are to be made is first split into a workpiece and a waste part along a parting surface which extends through said blank from end to end and from side to side thereof, the profile of said parting surface being substantially the same as the contour of the simulated decorative architectural column of the present invention into which said jacket wedges are to be incorporated.

In accordance with a yet further principal feature of the present invention said workpiece is then subdivided along a plurality of substantially planar oblique surfaces, thereby dividing said workpiece into a plurality of jacket wedges and a plurality of waste wedges.

In accordance with another principal feature of the present invention the uppermost portions of said oblique surfaces, i.e., those portions nearest the planar end portion or portions of said parting surface, may terminate at a short distance from said end portion or portions of said parting surface, and thus live hinges may be formed between adjacent ones of said jacket wedges.

In accordance with a further principal feature of the present invention said adjacent jacket wedges may, alternatively, be joined together by removable adhesive tape or the like in order to integrate pluarlities of said jacket wedges into unitary wedge assemblies, thereby rendering easier the assembly of one or more of said pluralities of jacket wedges into a simulated decorative architectural column of the present invention.

In accordance with a yet further principal feature of the present invention some or all of the jacket wedges of a column jacket of the present invention may be quickly and cheaply packaged for shipment from the jacket wedge manufacturing site to a distant column fabrication site by juxtaposing those jacket wedges, their associated waste wedges, and the waste part(s) of the blank(s) from which they were cut in the same juxtaposition in which they were collocated in said blank(s), and then temporarily re-joining the associated jacket wedges, waste wedges and waste parts together, as by banding.

In accordance with another principal feature of the present invention two or more subpluralities of the jacket wedges of the jacket of a particular simulated decorative architectural column of the present invention may be permanently adhered together at the site of manufacture of the jacket wedges, thus to provide one or more jacket segments, and the jacket segments of said particular simulated decorative architectural column may then be shipped to the column fabrication site, so that the complete column jacket can be quickly and easily fabricated at the column fabrication site.

In accordance with yet another principal feature of the present invention the outer surface of the thus fabricated jacket may then be sanded to sublate the individual outer wedge faces, so that the jacket will present a smooth, rather than faceted, outer surface.

In accordance with a further principal feature of the present invention said smooth outer surface of the partially completed simulated decorative architectural column of the present invention may then be provided with an overcoating of fiberglass and stucco, or other suitable coating material, whereby to provide said simulated decorative architectural column of the present invention with a relatively impact-resistant surface resembling stone or other desired material.

For a fuller understanding of the nature and objects of the present invention, reference should be had to the following detailed description, taken in connection with the accompanying drawings.

BRIEF DESCRIPTION OF THE DRAWINGS

It is to be understood that different views of the same or like parts are designated in the several figures of the drawings by the same designator.

DESCRIPTION OF THE PREFERRED EMBODIMENTS

Figure 1:
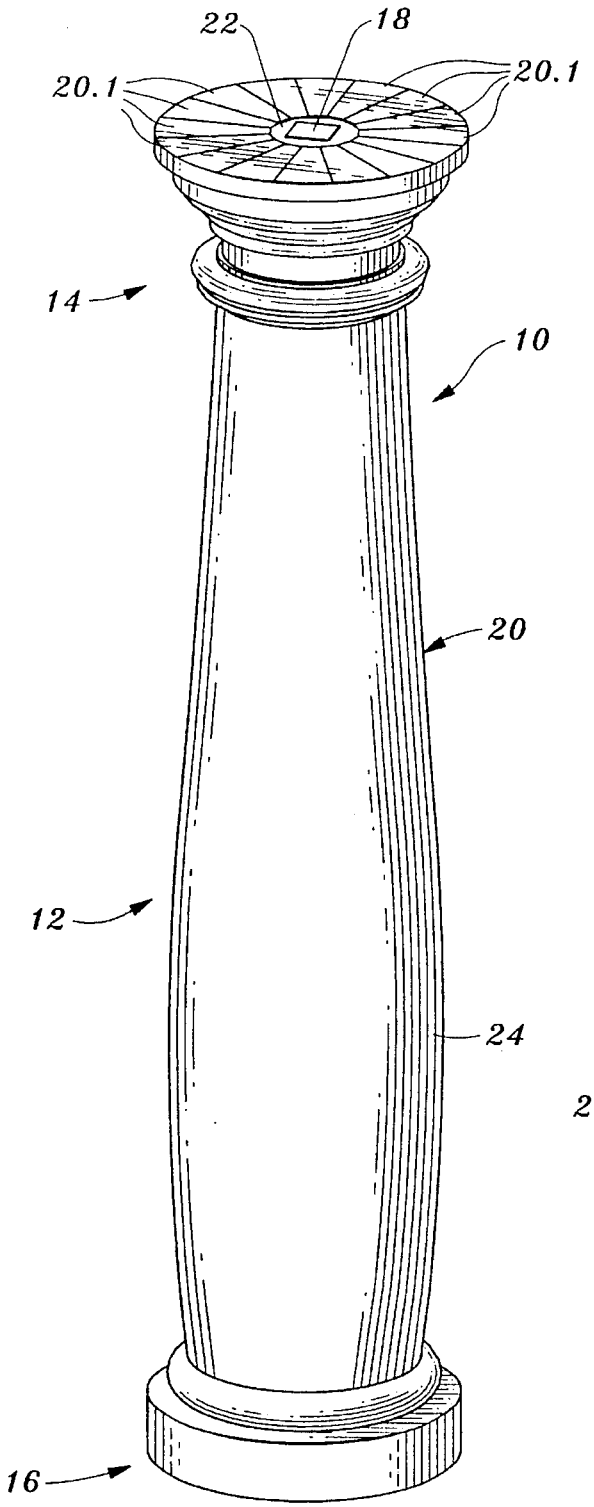
FIG. 1 is a perspective view of a simulated decorative architectural column of the first preferred embodiment of the present invention.

Referring now to FIG. 1, there is shown a simulated decorative architectural column 10 embodying certain aspects of the present invention.

As seen in FIG. 1, simulated decorative architectural column 10 is configured in accordance with classic architectural orders, and is characterized by a certain convexity of the profile of the shaft thereof which is known in classical architecture as "entasis".

In accordance with conventional nomenclature, simulated column 10 is considered to consist of three parts, viz., a central portion 12 of unbroken profile called the "shaft", an upper portion 14 called the "capital", and a lower portion 16 called the "base".

It is to be understood that the present invention embraces many simulated decorative architectural columns, of classical architectural orders, of neo-classical architectural orders, and of many other forms.

Figure 2:
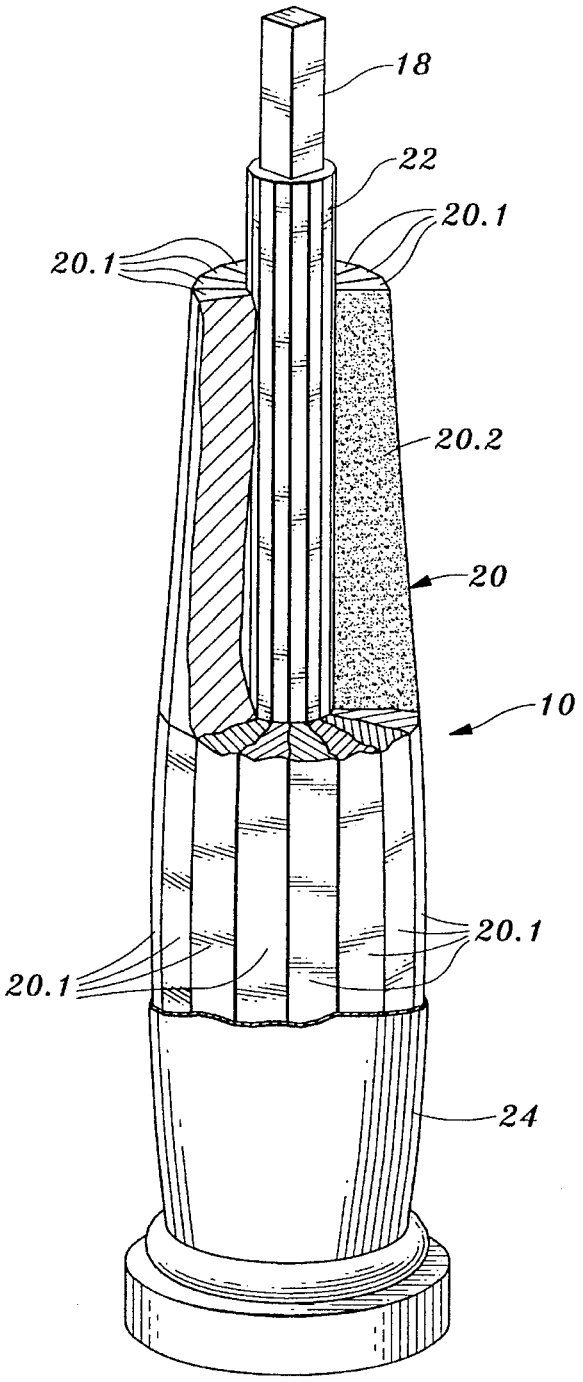
FIG. 2 is a corresponding perspective view of the simulated decorative architectural column of the first preferred embodiment of the present invention shown in FIG. 1, cut away at several places to illustrate the component parts of the simulated decorative architectural column of the first preferred embodiment of the present invention shown in FIG. 1.

Referring now to FIG. 2, it will be seen that simulated column 10 is principally comprised of a post or core 18 which is surrounded by a jacket 20.

As also seen in FIG. 2, simulated column 10 is further comprised of a body 22 of filler material, such as injected spray foam, which fills the void between post or core 18 and jacket 20, and maintains them in concentric relation.

It is to be understood that the present invention also embraces embodiments in which the jacket thereof close-fittingly embraces the post or core thereof, and thus no intermediate material is needed.

While post 18 shown in FIG. 2 is a four-inch-by-four inch timber support or prop which functions to support overlying building structure, it is to be understood that the core, post or other architectural support member of other embodiments of the invention may be, e.g., a hollow cardboard tube filled with concrete, or a section of heavy metal pipe, or an I-beam, or any other form of elongated architectural support member known to those having ordinary skill in the building construction art.

As further seen in FIG. 2, jacket 20 is comprised of a plurality of elongated members 20.1 of generally wedge-shaped, or truncated wedge-shaped, cross-section which are called "jacket wedges" herein.

Each jacket wedge 20.1, or other jacket wedge shown and described hereinafter, is preferably fabricated from rigid foam material such as virgin expanded polystyrene (EPS), an environmentally-safe, recyclable, closed-cell, light-weight, stable, non-toxic rigid foam plastic material having a Class A fire rating. It is to be understood, however, that many other varieties of rigid foam material may be utilized in practicing the present invention.

As further seen in FIG. 2, a radially-disposed face 20.2 of one of the jacket wedges 20.1 is coated with a suitable adhesive, such as Henry Adhesive No. 117.

Thus, it is to be understood that each of the jacket wedges 20.1 of simulated column 10 is adhered to its adjacent jacket wedges 20.1 by means of a suitable adhesive, such as Henry Adhesive No. 117, which covers a substantial part or all of the mutually confronting radially-directed faces of each pair of jacket wedges 20.1.

In simulated decorative architectural columns of the invention the jackets thereof may typically be comprised of 16 to 24 jacket wedges, although in some embodiments the number of jacket wedges may exceed 24, and in any case the width of the outer faces of the jacket wedges should not exceed 4 inches.

As will now be understood by those having ordinary skill in the art, informed by the present disclosure, the jacket of a simulated decorative architectural column of the invention, when the jacket wedges thereof are first adhered to each other, will present a faceted appearance, each facet being the outer face of one of the component jacket wedges.

It is to be understood as part of the present invention that the outer face of such an intermediate stage jacket will then be sanded to sublate or eliminate the individual facets, so that the outer face of the jacket will present a smooth, substantially continuous surface.

Figure 5:
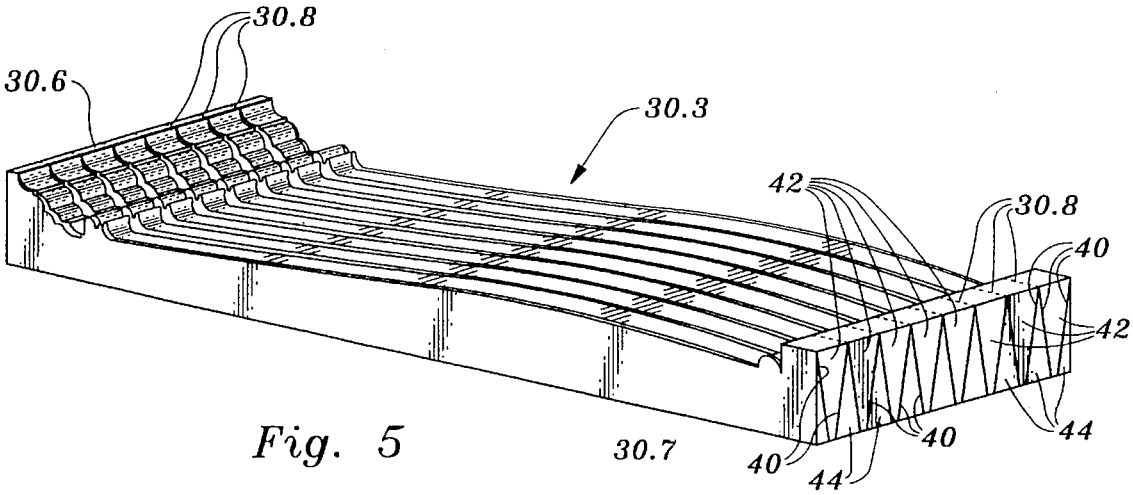
FIG. 5 is a perspective view of the workpiece of the column blank shown in FIG. 4, which has been divided into jacket wedges and waste wedges by a plurality of oblique cuts in accordance with the teachings of the present invention.

As may be seen, for example, in FIG. 5, not only the shaft but also the base and capital of certain simulated decorative architectural columns of the present invention are formed from the jacket wedges thereof.

It is to be understood, however, that the present invention also embraces embodiments in which at least part of the capital or base of the column, or both of them, are separately fabricated.

It is also to be understood that while the central (axial) members, e.g., post 18, of certain simulated decorative architectural columns of the present invention may be load bearing members, such as wooden support posts, the central (axial) members of other embodiments of the invention may merely be cores, i.e., elements not intended to bear any load, as when simulated decorative architectural columns of the present invention are prepared for use in theatrical stage settings.

As further seen in FIGS. 1 and 2, jacket 20, after being sanded smooth, is provided with an overcoating 24 whereby the surface of simulated column 10 is caused to have the appearance of stone or other structural material, and is rendered more resistant to local impact than is the surface of uncoated rigid foam material.

As will be understood by those having ordinary skill in the art, numerous coating materials can be used for providing overcoating 24, such as cementitious base coats, stucco, E.I.F.S. systems, veneer plaster, drywall compound, epoxy resins, and latex and water-based paints. Other non-solvent-based materials can also be used, first determining that such materials will not etch the foam, and that the particular selected material bonds well to the foam surface.

It is also to be understood that overcoating 24 may be comprised of a plurality of separate coatings. For example, the immediately above-described outer coating may be underlain with a coating of the type known in the trade as XL Coat, which may be applied by the use of a trowel, brush, float, or small hopper sprayer. It is further to be understood that this base coating may be as thick as ⅛ inch, in order to impart good impact resistance.

It is also to be understood that fiberglass in the form of strand or mesh may be incorporated into said base coating.

Figure 3:
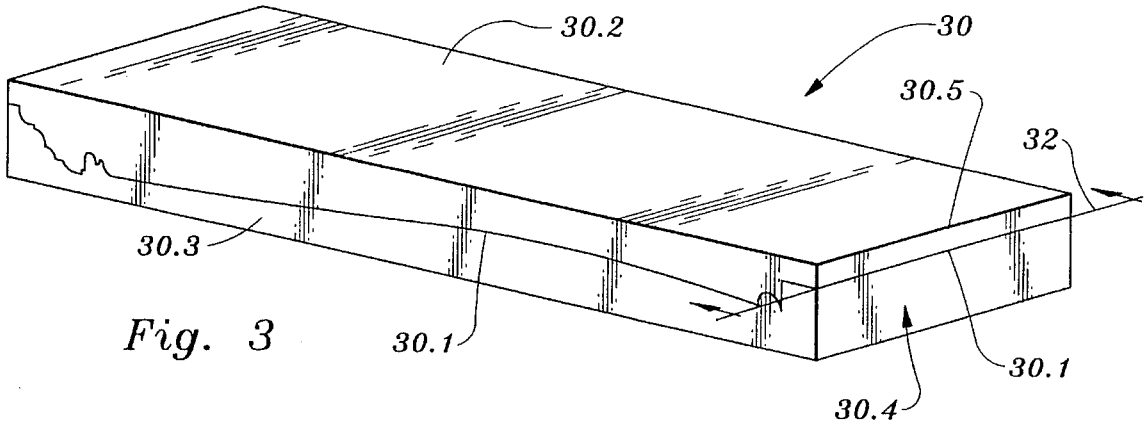
FIG. 3 is a perspective view of a blank of rigid foam material divided into a workpiece and a waste part in accordance with the teachings of the present invention.
Figure 4:
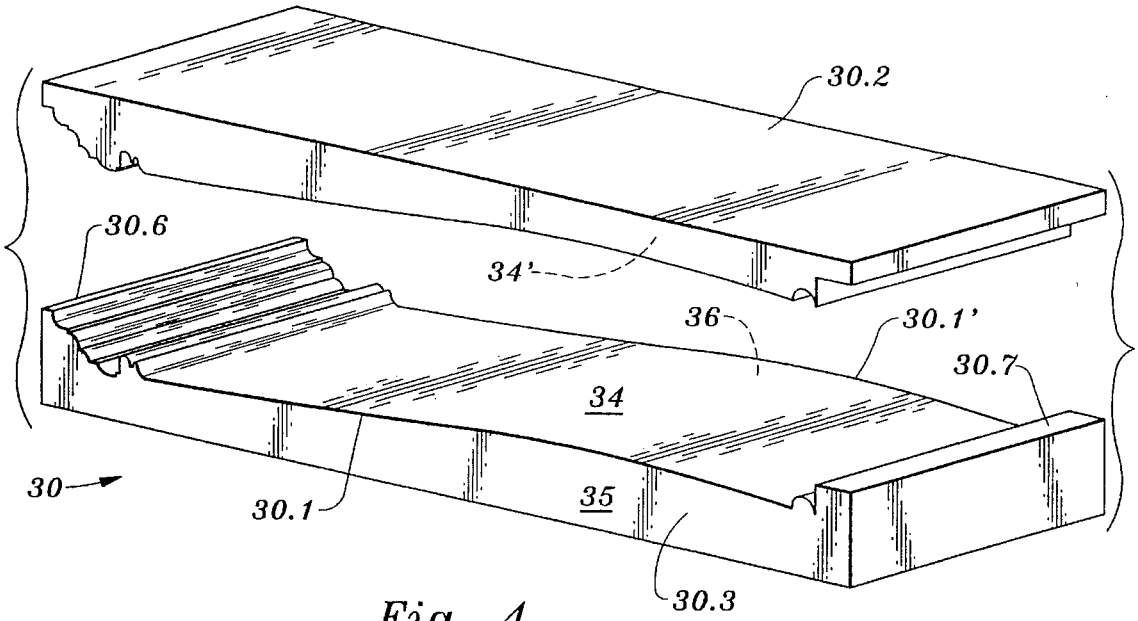
FIG. 4 is an exploded view of the cut blank of FIG. 3, with the waste part and the workpiece separated in order to disclose the parting surface therebetween.

Referring now to FIGS. 3, 4 and 5, there is illustrated the method of simultaneously fabricating the jacket wedges of a column jacket of the present invention, which method is itself a principal feature of the present invention.

It is to be understood that the foam cutting steps of this method of the present invention are to be carried out by means of a pattern-following hot-wire foam cutting machine which is controlled by a pattern represented on a control drawing, such machines being well known to those having ordinary skill in the art.

Such pattern-following hot-wire foam cutting machines may hereinafter be referred to simply as "foam cutting machines".

Referring now to FIG. 3, there is shown a blank 30 of rigid foam as it appears after the carrying out of the first step of this method.

As seen in FIG. 3, blank 30 has been subdivided by a cut 30.1 into two parts 30.2 and 30.3.

In carrying out the jacket wedge fabricating method of the present invention, cut 30.1 was made by clamping blank 30 onto the bed of a hot-wire foam cutting machine of the abovedescribed type the cutting wire 32 of which was initially closely disposed to end face 30.4 of blank 30, and was horizontal, i.e., parallel to edge 30.5 of blank 30.

Hot-wire 32 was then relatively moved through blank 30, remaining at all times parallel to the upper and lower faces of blank 30, one point thereof tracing the profile of cut 30.1 shown in FIG. 3.

As is well known to those having ordinary skill in the art, the configuration of the said profile of cut 30.1 is determined, in the operation of said hot-wire foam cutting machine, by a photoelectric line-following device which follows a pattern represented on a control drawing which is suitably juxtaposed to the line-following device during the making of cut 30.1, the distance of hot-wire 32 above the bed of said hot-wire foam cutting machine, i.e., above the bottom face of blank 30, being determined at every instant during the making of cut 30.1 by said line-following device following said pattern represented on said control drawing.

Referring now to FIG. 4, there is shown an exploded view of blank 30 wherein the waste part 30.2 and the workpiece or relievo part 30.3 of blank 30 are vertically separated from each other for clarity of illustration.

As seen in FIG. 4, workpiece 30.3 has a curved upper face 34 which extends from end to end thereof, and from side to side thereof.

As will be understood by those having ordinary skill in the art, informed by the present disclosure, upper face 34 of workpiece 30.3 was completely generated by hot wire 32, and did not exist in blank 30 until the passage therethrough of hot wire 32.

Since the parting between waste part 30.2 and workpiece 30.3 of blank 30 takes place between upper face 34 of workpiece 30.3 and the lower, curved face 34' of waste part 30.2, each of these faces will hereinafter be called a "parting surface".

As will now be obvious to those having ordinary skill in the art, informed by the present disclosure, the contour of parting surface 34 is substantially identical to the contour of parting surface 34', but in mirror image.

In accordance with the teachings of the present invention, the common profile of each of the curved edges 30.1, 30.1' of parting surface 34 is substantially identical to the intended profile of the column which is to be fabricated from the jacket wedges which will subsequently made from workpiece 30.3 by following the steps set out hereinafter in connection with FIG. 5, which steps, taken with the steps disclosed hereinabove in connection with FIGS. 3 and 4, constitute the novel method which is a principal feature of the present invention.

After the fabrication of workpiece 30.3 (FIG. 4) in the manner indicated hereinabove, workpiece 30.3 is unclamped from the bed of said hot-wire foam cutting machine.

Workpiece 30.3 is then turned through 90 degrees about its major axis, so that it then stands on one side on the bed of the hot-wire foam cutting machine, i.e., with side face 35 of used part 30.3 bearing directly on the bed of the hot-wire foam cutting machine.

In the orientation just described, workpiece 30.3 is then clamped to the bed of said hot-wire foam cutting machine in the well known manner.

By means of said hot-wire foam-cutting machine, workpiece 30.3 is then subdivided by a plurality of cuts 40 (FIG. 5) into a plurality of jacket wedges 42 and a plurality of waste wedges 44.

As will be evident to those having ordinary skill in the art, informed by the present disclosure, each jacket wedge 42 and each waste wedge 44 extends from end to end of workpiece 30.3. Each cut 40 also extends from end to end of workpiece 30.3, and lies in a plane unique to it.

As will also be evident to those having ordinary skill in the art, informed by the present disclosure, all of the jacket wedges used in fabricating a single column of the invention will not necessarily be fabricated from a single blank 30.

In accordance with a principal feature of the present invention, it may be found desirable in some cases to discontinue each cut 40 a very short distance from the planar faces 30.6, 30.7 of workpiece 30.3, thus providing live hinges between adjacent used jacket wedges 42, which live hinges are indicated in FIG. 5 by the respective dashed lines 30.8.

As will be evident to those having ordinary skill in the art, informed by the present disclosure, live hinges 30.8 will join the jacket wedges 42 fabricated from a single blank 30 into a unified subassembly.

Figure 6:
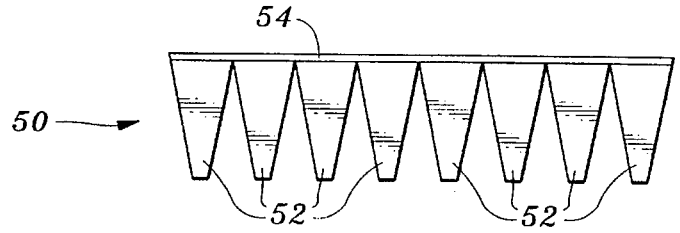
FIG. 6 illustrates the manner of joining together a sub-plurality of the jacket wedges of a column of the present invention by removable tape or the like in accordance with the teachings of the present invention.

Referring now to FIG. 6, there is shown a column subassembly 50 of the present invention. Column subassembly 50 is substantially identical to the unified subassembly described hereinabove but for the fact that hinges 30.6, 30.8 (FIG. 5) are replaced by an adhesive tape 54 which is easily removable after the adjacent faces of the jacket wedges 52 of subassembly 50 have been cemented together as taught hereinabove to form a jacket segment, or a complete jacket.

Figure 8:
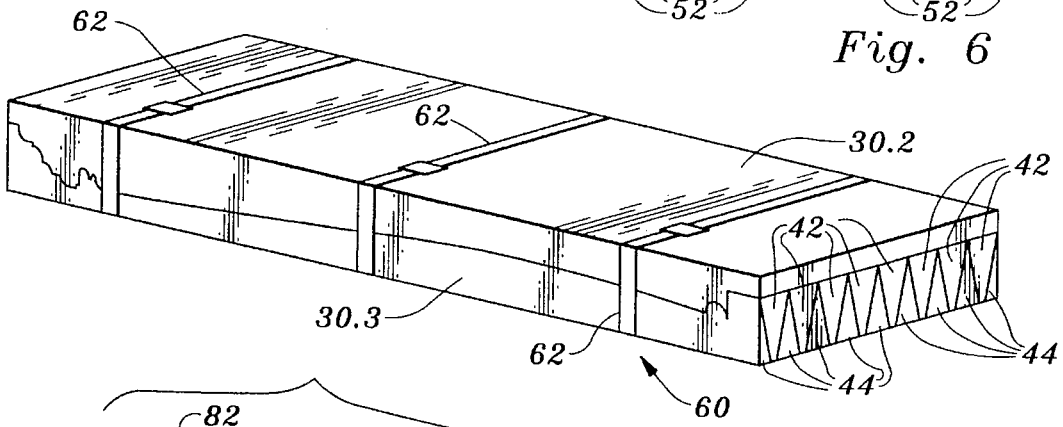
FIG. 8 illustrates the manner of joining together, as by banding, the jacket wedges, the waste wedges and the waste parts of a column wedge blank of the present invention for convenient shipping to the column fabrication site.

Referring now to FIG. 8, there is shown a jacket subassembly package 60 of the present invention.

In accordance with a principal feature of the present invention, jacket subassembly packages of the present invention, or temporarily joined sets of jacket wedges, are prepared for shipping from the wedge manufacturing site to the site of column fabrication, after the jacket wedges of a column or column segment have been made in accordance with the method of the present invention described hereinabove in connection with FIGS. 3 through 5, by placing the associated waste part (e.g., waste part 30.2 seen in FIG. 4), on its formerly associated jacket wedges 42 and waste wedges 44, and then strapping together the jacket wedges 42, hinged or not hinged, the waste wedges 44, and the waste part 30.2 by means of packaging straps 62 of well known type, resulting in the jacket subassembly package 60 of FIG. 8.

As will now be understood by those having ordinary skill in the art, informed by the present disclosure, the total number of jacket wedges for a single column may conveniently be shipped to the site of column fabrication by assembling subgroups of those jacket wedges into jacket subassembly packages similar to jacket subassembly package 60 of FIG. 8, whereupon the resulting jacket subassembly packages can readily be shipped to the column fabrication site.

When the total number of jacket subassembly packages containing the total number of jacket wedges for a single jacket are thus gathered at the column fabrication site, the packaging bands of those jacket subassembly packages may then be removed, and the jacket wedges separated from their associated waste parts and waste wedges; whereupon the jacket wedges, i.e., the wedges to be used in fabricating said single column, may be cemented together, around the associated post or core.

The particular simulated decorative architectural column of the invention may then be finished by sanding the jacket to sublate or eliminate its facets as abovedescribed, and by then providing an overcoating over the resulting smooth outer surface of the jacket, as also described hereinabove.

Figure 7:
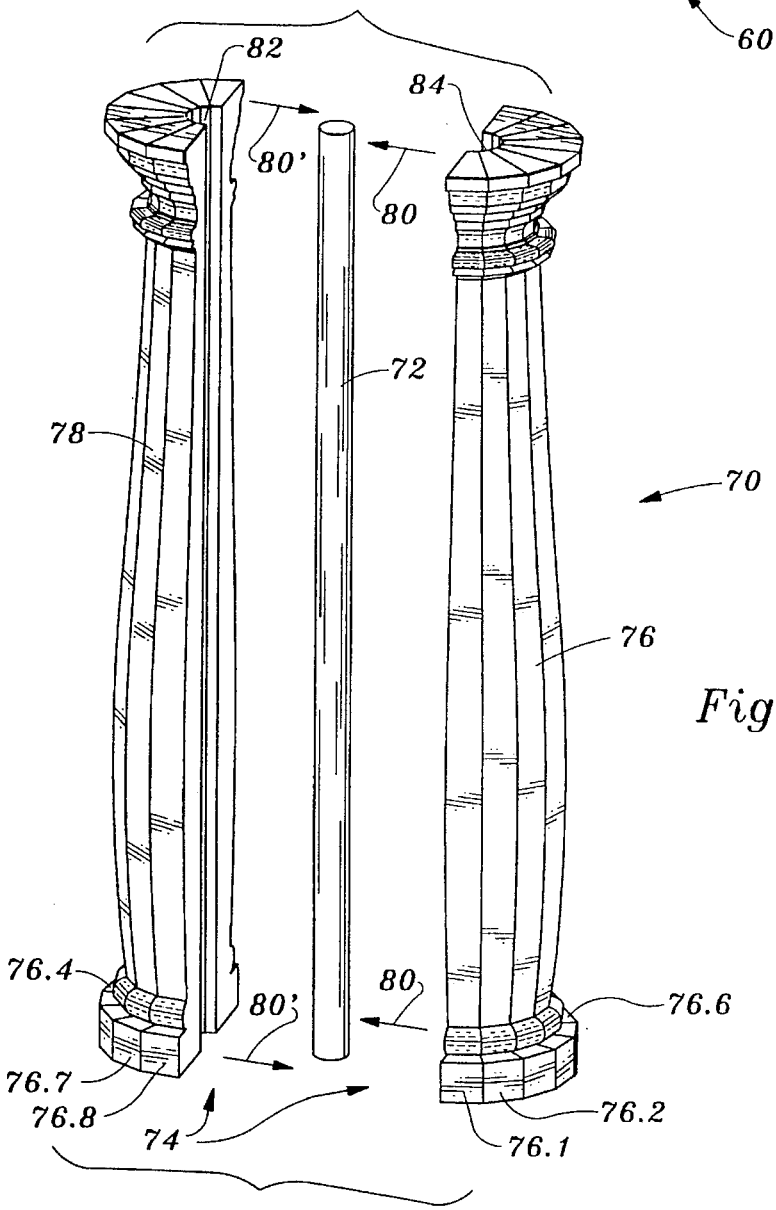
FIG. 7 is a perspective drawing of a plurality of jacket segments, each fabricated from a plurality of jacket wedges in accordance with the present invention, and the manner of joining the same around the core, post or other architectural support member of the column of the present invention of which these jacket segments of the present invention are a part.

Referring now to FIG. 7, there is shown a partially fabricated simulated decorative architectural column 70 of the present invention.

As shown in FIG. 7, partially fabricated column 70 is comprised of an axial member 72. As taught hereinabove, axial member 72 may be a post or other architectural support member, or structural member, such as a wooden post, an I-beam or a concrete-filled cardboard tube, which is incorporated in the building or other structure to which the column or columns of the present invention are to be fitted.

On the other hand, within the scope of the present invention axial member 72 may be a core, such as an elongated wooden member which does not extend beyond the respective ends of the associated column jacket 74 (FIG. 7).

Thus, it is to be understood that the term "axial member", as used in this specification and in the claims appended hereto, denotes both architectural support members and non-supporting cores existing only within their associated column jackets.

As further seen in FIG. 7, a first jacket segment 76 is located on one side of axial member 72, and a second jacket segment 78 is located on the other side of axial member 72.

As will now be evident to those having ordinary skill in the art, informed by the present disclosure, each segment 76, 78 shown in FIG. 7 is comprised of eight jacket wedges of the kind described hereinabove. The wedges of each jacket segment 76, 78 are adhered to each other in the respective juxtapositions shown in FIG. 7 by a suitable adhesive, e.g., No. 117 Henry Adhesive.

Each segment of jacket 76 is designated by one of the reference numerals 76.1 through 76.8; and each segment of jacket 78 is designated by one of the reference numerals 78.1 through 78.8.

While column 70, as shown in FIG. 7, is comprised of sixteen jacket wedges for clarity of illustration, it is to be understood that in many preferred embodiments of the present invention twenty-four jacket wedges will be employed; and that in some embodiments of the present invention more than twenty-four jacket wedges will be employed.

It is further to be understood that while column 70 (FIG. 7) is formed from two jacket segments 76, 78 it may be found desirable, without the exercise of invention, to employ more than two jacket segments in certain embodiments of the present invention.

It is to be particularly understood that in accordance with a method of column fabrication which is a principal feature of the present invention, as illustrated, e.g., in FIG. 7, the jacket wedges of a simulated decorative architectural column of the present invention will not be shipped as individual, unjoined parts from the site of wedge manufacture to the site of column fabrication, but rather subpluralities of jacket wedges will be adhered together at the site of wedge manufacture to provide two or more column segments, such as segment 76, 78 shown in FIG. 7, and the individual, unjoined segments will then be shipped to the column fabrication site, rather than the individual, unjoined jacket wedges.

Thus, in accordance with this preferred column fabrication method of the present invention, as shown in FIG. 7, two jacket segments 76, 78 are shipped from the manufacturing site to the column fabrication site, and then are coated on their mutually facing flat surfaces with a suitable adhesive; whereupon they are joined around core 72 by moving them in the directions of the arrows 80, 80' of FIG. 7, and then pressing them together to join the adhesive-coated flat surfaces.

Thus, core 72 (FIG. 7) comes to be completely surrounded by jacket 74 in close-fitting relationship.

Since core 72 is of circular cross-section, and its diameter is substantially equal to the common diameter of the core receiving channels 82, 84 of the respective jacket segments 78, 76, shown in FIG. 7, it follows that jacket 74 close-fittingly receives core 72, and that thus only a coating of adhesive need be provided between core 72 and jacket 74.

Further, in accordance with other embodiments of the present invention, and as best seen in FIG. 2, the axial members of the columns of certain preferred embodiments of the present invention may be smaller in cross-section than the channels of the jacket segments thereof, and thus filler material will be provided between the core and the channel walls, as in the embodiment of FIGS. 1 and 2, wherein the filler material is identified by the reference numeral 22.

When jacket segments 76, 78 (FIG. 7) have been closed around core 72, and cemented thereto, in accordance with some of the column fabrication methods of the present invention, the faceted outer face of jacket 74 will be sanded to produce a smooth, unfaceted outer face.

Further, in accordance with certain column fabrication methods of the present invention, the smooth outer face of jacket 74 will be provided with an overcoating, e.g., of fiberglass and stucco, which preferably causes the outer surface of jacket 74 to resemble the outer surface of a stone column made entirely of, e.g., limestone.

It will thus be seen that the objects set forth above, among those made apparent from the preceding description, are efficiently attained, and since certain changes may be made in the above constructions and the methods carried out thereby without departing from the scope of the present invention, it is intended that all matter contained in the above description, or shown in the accompanying drawings, shall be interpreted as illustrative only, and not in a limiting sense.

It is also to be understood that the following claims are intended to cover all of the generic and specific features of the invention hereindescribed, and all statements of the scope of the invention which, as a matter of language, might be said to fall therebetween.

What is claimed is:

1. A simulated decorative architectural column including one or more of a shaft portion, a base portion and a capital portion, comprising:

an axial member; and a jacket surrounding said axial member;

said jacket being comprised of a plurality of elongated jacket wedge members, each of which jacket wedge members is of truncated wedge-shaped cross-section, has an elongated outer face the profile of which is substantially identical to the intended profile of at least a shaft portion of the column, has two opposed major faces of greater area than any of the other faces thereof, and is formed from rigid foam material; and each of said jacket wedge members being substantially parallel to the axis of said axial member.

2. A simulated decorative architectural column as claimed in claim 1 in which said elongated outer face profiles of said jacket wedge members are substantially congruent with the profiles of a shaft portion, a base portion and a capital portion of said column.

3. A simulated decorative architectural column as claimed in claim 1 in which said outer face profiles of said jacket wedge members are substantially congruent with the profile of a shaft portion of said column.

4. A simulated decorative architectural column as claimed in claim 1 in which a plurality of said elongated jacket wedge members are fabricated from a single block of rigid foam material.

5. A simulated decorative architectural column as claimed in claim 1 in which said jacket wedge members are adhered to each other and the outer face of said adhered-together jacket wedge members is sanded to present a smooth outer face.

6. A simulated decorative architectural column as claimed in claim 5 in which said smooth outer face is provided with an overcoating simulating a cut stone surface.

7. The method of making a simulated decorative architectural column including one or more of a shaft portion, a base portion and a capital portion, comprising the steps of:

fabricating a plurality of elongated jacket wedge members, each of which jacket wedge members is of truncated wedge-shaped cross-section, has an elongated outer face the profile of which is substantially identical to the intended profile of at least a shaft portion of the column, has two opposed major faces of greater area than the area of any other face thereof, and is formed from rigid foam material; and adhering said major faces of said jacket wedge members together to produce a jacket the outer face of which is subdivided into a plurality of elongated facets, each of which facets has two elongated edges, the configuration of said elongated the edges of said facets being similar to the intended profile of at least the shaft portion of said column.

8. The method of making a simulated decorative architectural column as claimed in claim 7, further comprising the step of sanding the outer face of said jacket to eliminate said facets and thus provide said jacket with a smooth outer face.

9. The method of making a simulated decorative architectural column as claimed in claim 8, further comprising the step of applying to said smooth outer face an overcoating simulating a cut stone surface.

10. The method of making a simulated decorative architectural column as claimed in claim 7, further comprising the steps of:

fabricating a plurality of said jacket wedge members from a single block of rigid foam material;

reassembling said single block of rigid foam material after the fabrication of said jacket wedge members; and securing said jacket wedge members of said single block of rigid foam material together by temporary securing means.

11. The method of making a simulated decorative architectural column including a shaft portion, comprising the steps of:

fabricating a plurality of elongated jacket wedge members, each of which jacket wedge members is of truncated wedge-shaped cross-section, has an elongated outer face the profile of which is substantially identical to the intended profile of at least the shaft portion of the column, has two opposed major faces of greater area than the area of any other face thereof, and is formed from rigid foam material; and adhering said major faces of said jacket wedge members together to produce a jacket the outer face of which is subdivided into a plurality of elongated facets, each of which facets has two elongated edges the configuration of said elongated edges of said facets being similar to the intended profile of at least the shaft portion of said column, and at least one plurality of said jacket wedge members not being completely separated from each other, thereby providing live hinges between the jacket wedge members of said plurality.

12. The method of making a simulated decorative architectural column including a shaft portion, comprising the steps of:

fabricating a plurality of elongated jacket wedge members, each of which jacket wedge members is of truncated wedge-shaped cross-section, has an elongated outer face the profile of which is substantially identical to the intended profile of at least the shaft portion of the column, has two opposed major faces of greater area than the area of any other face thereof, and is formed from rigid foam material;

adhering said major faces of said jacket wedge members together to produce a jacket the outer face of which is subdivided into a plurality of elongated facets, each of which facets has two elongated edges the configuration of said elongated edges of said facets being similar to the intended profile of at least the shaft portion of said column; and temporarily joining at least a plurality of said jacket wedge members by removably adhering to said outer faces thereof a sheet of flexible material which temporarily maintains said jacket wedge members of said plurality in operative juxtaposition.

* * * * *